US006536732B1

(12) United States Patent
Chang

(10) Patent No.: US 6,536,732 B1
(45) Date of Patent: Mar. 25, 2003

(54) SWIVEL MECHANISM FOR FOLDABLE FURNITURE

(76) Inventor: Tony Wei-Sin Chang, 1416 Johnson Ave., San Jose, CA (US) 95129

( * ) Notice: Subject to any disclaimer, the term of this patent is extended or adjusted under 35 U.S.C. 154(b) by 159 days.

(21) Appl. No.: 09/689,576

(22) Filed: Oct. 11, 2000

Related U.S. Application Data

(63) Continuation-in-part of application No. 09/617,453, filed on Jul. 17, 2000, now abandoned.

(51) Int. Cl.[7] ..... A47C 4/50
(52) U.S. Cl. ..... 248/349.1; 108/94; 297/344.21
(58) Field of Search ..... 248/349.1, 431; 108/94; D07/501; 297/344.21, 344.26, 195.11, 16.7; 211/163

(56) References Cited

U.S. PATENT DOCUMENTS 335,823 A * 2/1886 Linden
1,337,059 A * 4/1920 Fisher
1,428,275 A * 9/1922 Dahl

* cited by examiner

*Primary Examiner*—Alvin Chin-Shue

(57) ABSTRACT

A swivel mechanism for foldable furniture includes two disks and a rotatable assembly sandwiched in between. Each disk has a plurality of through holes each for receiving an elongated metal tube and jointly connecting the tube to the disk. The through hole has a side wall with a slanted concave surface. A bridge member having one side with a slanted concave surface is formed across the through hole. When the metal tube is held in a slanted open position, the slanted concave surfaces of the side wall and the bridge member are engaged with the tube to provide strong support and restrain movement.

6 Claims, 17 Drawing Sheets

SWIVEL MECHANISM FOR FOLDABLE FURNITURE

This is a continuation-in-part of U.S. patent application Ser. No. 09/617,453, filed Jul. 17, 2000, now ABN.

FIELD OF THE INVENTION

The present invention relates to fordable furniture, and more specifically to foldable furniture having a swivel mechanism.

BACKGROUND OF THE INVENTION

Foldable furniture is very popular in recent years. People who enjoy outdoor activities such as camping, hunting and watching outdoor sport games usually carry foldable furniture with them. Foldable furniture of various designs have been manufactured for easy porting and carrying around outdoors. Foldable chairs or tables have almost become household necessities.

FIG. 1 illustrates an example of a foldable stool. As shown in FIG. 1, the foldable stool comprises three legs 101, a joint ring 102, and a piece of cloth 103 as the stool top. Each leg 101 is pivotedly connected to the joint ring 102 by a pivot pin. One end of each leg is affixed to the cloth 103. As can be seen, the stool can be put up by opening the three legs 101. The cloth 103 is flattened to form the top of the stool by the upper ends of the legs 101 that are then tightly held and restrained by the cloth 101. By collapsing the three legs 101 together, the stool can be folded for easy carrying.

The foldable stool offers great convenience for outdoor activities. However, as most people may have experienced, it is uneasy and inconvenient when sitting on such a stool and trying to swivel around. If one needs to turn around, he often has to stand up to avoid over twisting his necks or bodies.

To ease the above mentioned inconvenience of foldable furniture, swivel mechanism has been added to foldable furniture for a person to swivel around. However, the swivel mechanism is usually bulky and expensive. Therefore, making swivel furniture that is light, inexpensive and durable is a challenge to the sport furniture industry.

SUMMARY OF THE INVENTION

The present invention has been made to overcome the above mentioned inconvenience of conventional foldable furniture. The primary object of the invention is to provide a swivel mechanism for foldable furniture. The second object is to provide a swivel mechanism that is durable and can be manufactured with low cost. It is also an object of the invention to provide a swivel mechanism that can be easily integrated into different foldable furniture.

According to this invention, a swivel mechanism is provided for a foldable stool, chair or table. The furniture comprises an upper portion and a lower portion jointed together by the swivel mechanism. A plurality of leg members form the lower portion and a plurality of supporting members form the upper portion. The swivel mechanism comprises upper and lower disks stacked together. A recessed area is formed on the inner surface of each disk for housing a rotatable assembly between the two disks.

A plurality of through holes are formed in the upper disk to receive and joint the supporting members. One end of each supporting member is jointly connected to the upper disk within a through hole. The holes are shaped so that the supporting members can be opened up to support a stool top or a table top that may be formed by a piece of cloth. In a closed position, the supporting members can be folded and collapsed together.

Similarly, a plurality of through holes are also formed in the lower disk to receive and joint the leg members. One end of each leg member is jointly connected to the lower disk. The holes are shaped so that the leg members can be opened up as legs to allow the furniture to stand. In a closed position, the leg members can be folded and collapsed together.

In order to provide strong support and restrain too much movement of the leg or supporting member, a bridge member is formed within a through hole in the upper or lower disk. The bridge member has one side formed with a slanted concave surface. The through hole also has a side wall with a slanted concave surface. When the leg member or the supporting member is held in a slanted open position, the slanted concave surfaces are engaged with the leg member or the supporting member. Because of the engagement, the leg or supporting member is tightly restrained within the through hole. The foldable furniture can swivel around without denting or damaging the leg or supporting member at the joint end.

DETAILED DESCRIPTION OF THE PREFERRED EMBODIMENTS

Figure 1:
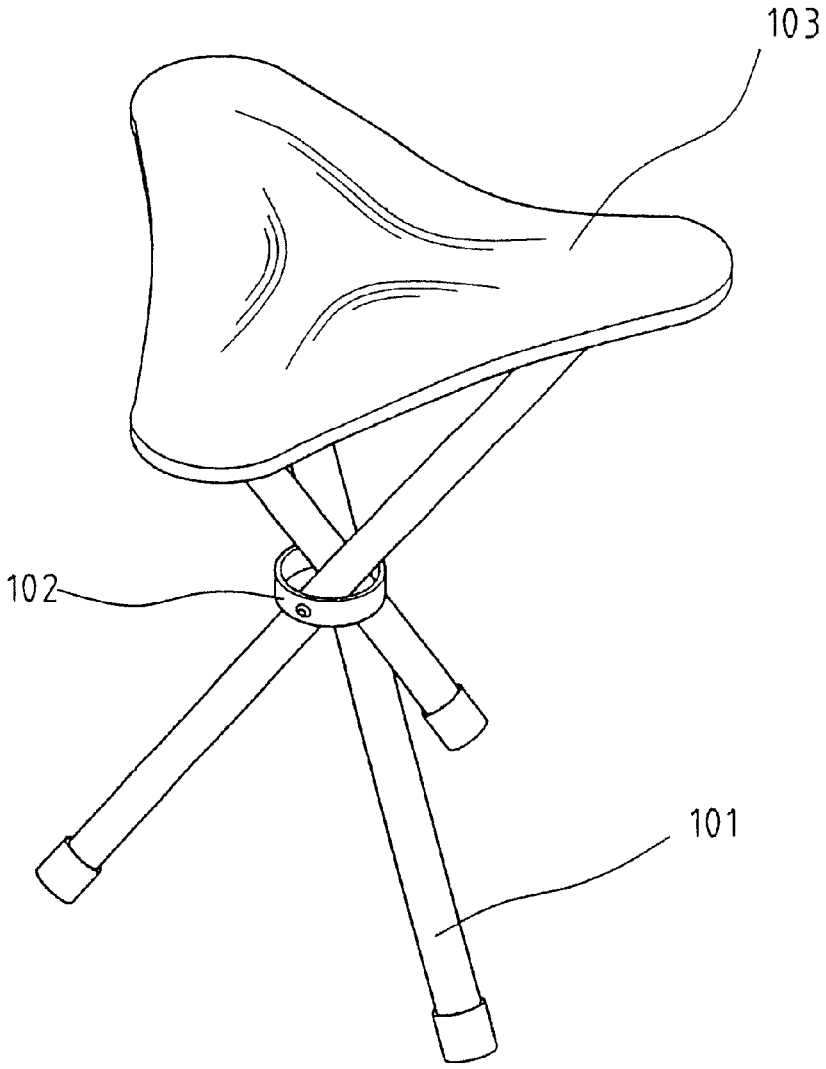
PRIOR ART FIG. 1
FIG. 1 shows an example of a conventional foldable stool.
Figure 2:
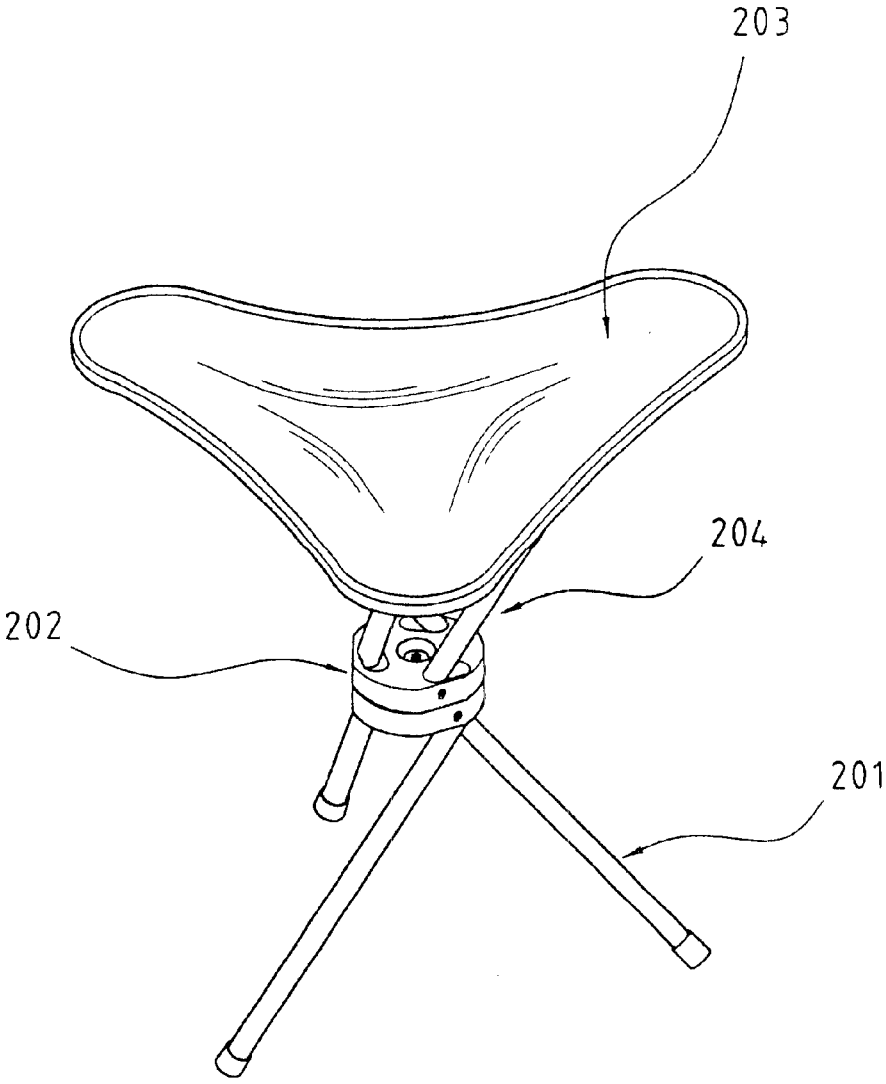
FIG. 2 shows a foldable swivel stool of this invention.

With reference to FIG. 2, a foldable swivel stool according to this invention comprises a lower portion that includes three leg members 201, a swivel mechanism 202, an upper portion that includes three supporting members 204, and a piece of cloth as the stool top 203. Both the leg members 201 and the supporting members 204 are jointly connected to the swivel mechanism 202. The stool top 203 is made of strong fabric such as canvas, rayon or nylon.

Figure 3:
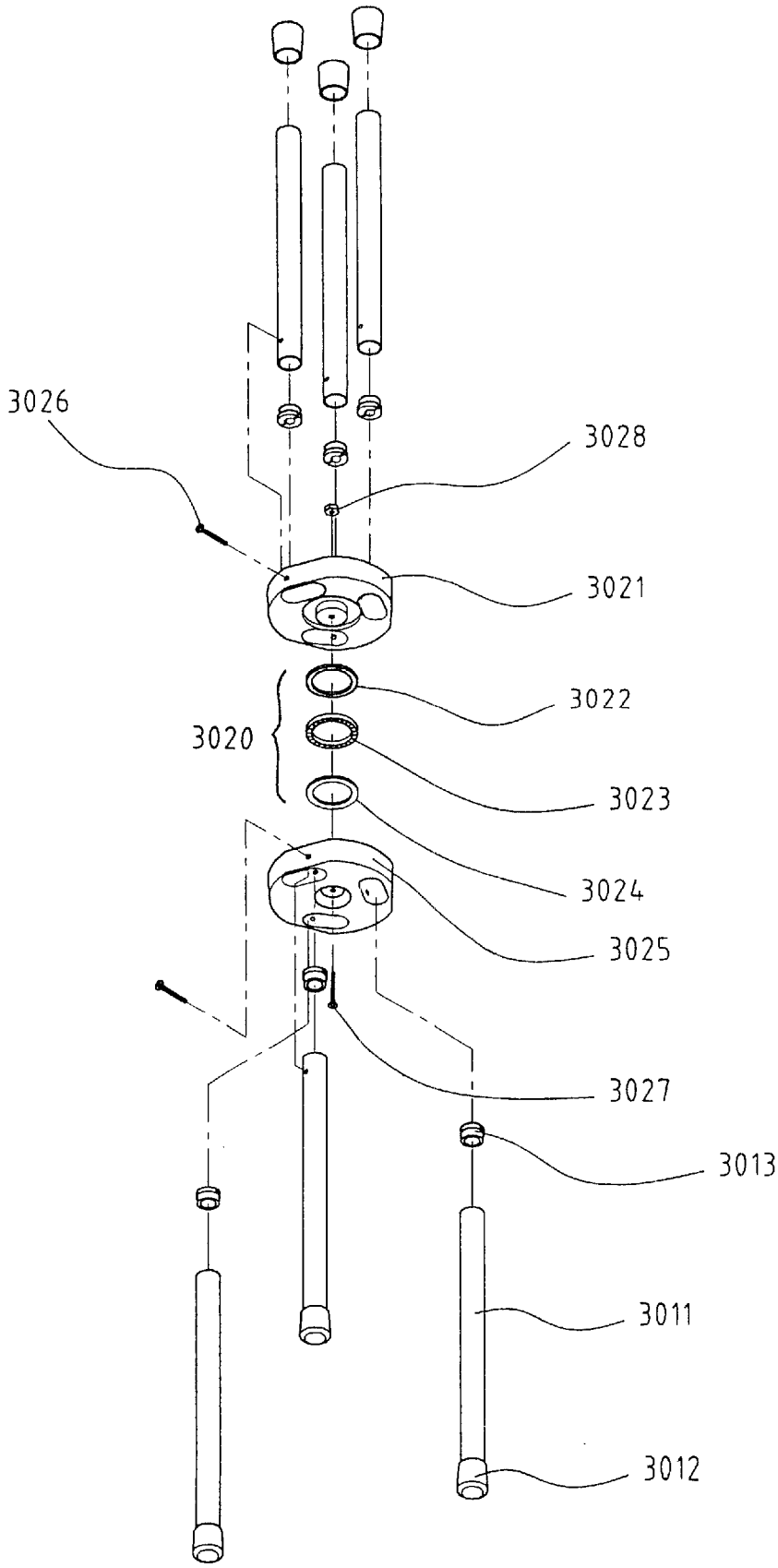
FIG. 3 shows a decomposed view of the foldable swivel stool of FIG. 2 without the stool top.

FIG. 3 shows a decomposed view of the foldable swivel stool without the stool top. The swivel mechanism comprises an upper disk 3021, a rotatable assembly 3020, and a lower disk 3025. Both upper and lower disks of the swivel mechanism have a number of through holes formed therein. The holes are located substantially symmetrical to the center of each disk.

Each leg member comprises an elongated tube 3011. One end of the tube is capped with a plastic cap 3012. The other end is jointly connected to the lower disk 3025 through a hole by means of a joint pin. The hole is slightly larger than the diameter of the tube 3011 and shaped so that the leg member can be held vertical to the disk or slanted and restrained within an angle. A plug member 3013 is inserted into the joint end of the tube for increasing the strength of the tube to prevent it from being dented or damaged when the leg member is slanted.

As can be seen from FIG. 3, the structure of a supporting member is very similar to that of a leg member. It is also formed by an elongated tube. One end of the tube is capped by a plastic cap and the other end is jointly connected to the upper disk 3021 through a hole by a joint pin 3026. The supporting member can be held vertical to the upper disk 3021 or slanted and restrained within an angle. A plug member is also inserted into the joint end of the tube to increase its strength.

Figure 4:
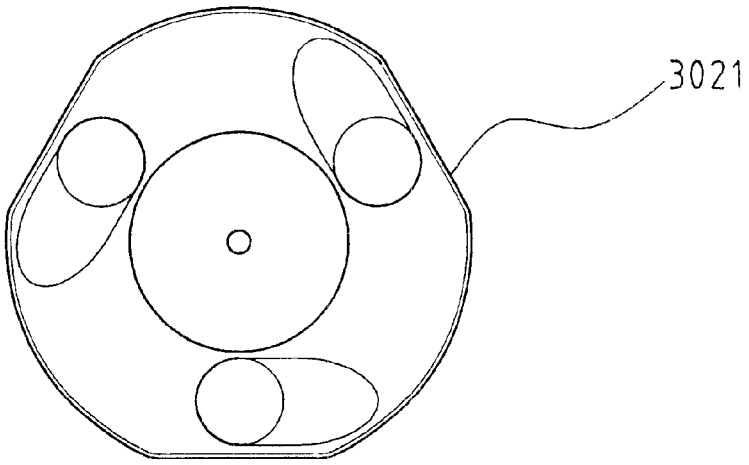
FIG. 4 shows a magnified view of the inner surfaces of the two disks comprised in the swivel mechanism according to the present invention.
Figure 4:
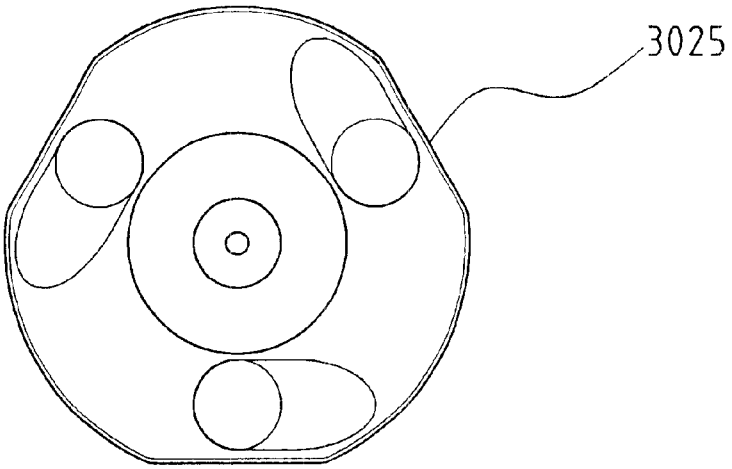

A recessed area is formed on the central part of the inner surface of each disk to create a space for. housing the rotatable assembly 3020. The inner surfaces of the upper and lower disks are shown in a magnified view illustrated in FIG. 4. The two disks are substantially identical to each other except that one may have a protruded center part in its recessed area for holding and fixing the rotatable assembly 3020. A small hole is formed through the center of each disk so that the two disks and the rotatable assembly can be assembled together by a fastening device such as a screw 3027 and a nut 3028 as shown in FIG. 3.

Figure 5:
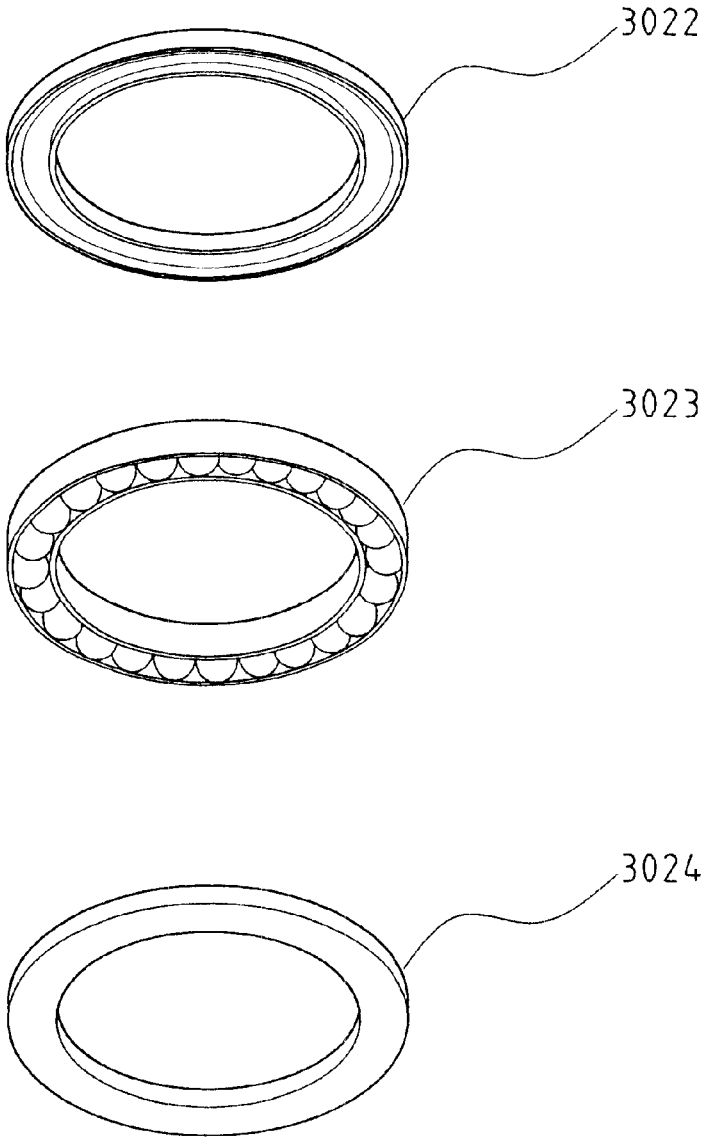
FIG. 5 shows a magnified view of the components of the rotatable assembly comprised in the swivel mechanism according to the present invention.

FIG. 5 shows a magnified view of a preferred embodiment of the rotatable assembly. It comprises an upper ring member 3022, a rotatable device 3023 and a lower ring member 3024. The rotatable device 3023 comprises a plurality of ball members housed in a groove formed on a ring-shaped body. Both upper and lower ring members have a curved surface to accommodate the ball members. When the upper ring member 3022, the rotatable device 3023 and the lower ring member 3024 are stacked together, the rotatable device can be rotated smoothly.

As mentioned earlier, the two disks have recessed areas for housing the rotatable assembly and one of the recessed areas may have a protruded center part to hold and fix the rotatable assembly. When the two disks and the rotatable assembly are assembled, a small gap is maintained between the upper and lower disks so that they can swivel freely.

As shown in FIG. 2, when the stool is in an opened position, each leg member is slanted and restrained so that the stool can stand stably. The supporting members are also slanted and restrained. Because each supporting member has one end affixed to the stool top 203, the stool top 203 also helps holding the supporting members together.

The preferred material for manufacturing the upper and lower disks is strong plastic material. It may be made of nylon or ABS (acrylo-mitrile butadiene-styrene). It may also be made of metal such as stainless steel. However, the cost would be increased. The rotatable assembly is usually made of metal. The preferred material for the ring members and the ball members is stainless steel. The tubes for making leg and supporting members are preferably made of light-weight alloy. The plug member at the end of a tube is usually made of nylon or ABS.

It should be noted that although in FIG. 3 and FIG. 5, three separate components are shown for the rotatably assembly, one of the ring members may be combined with the rotatable device to form a single body for easy. manufacturing.

The above description has shown the two disks and the rotatable assembly as separate components. However, it can be understood that one or both ring members may be embedded in the disks. For example, the upper disk may be manufactured with a built-in upper ring member embedded in the recessed area. It is also possible that a combined body of a ring member and the rotatable device is embedded in one of the two disks.

Figure 6:
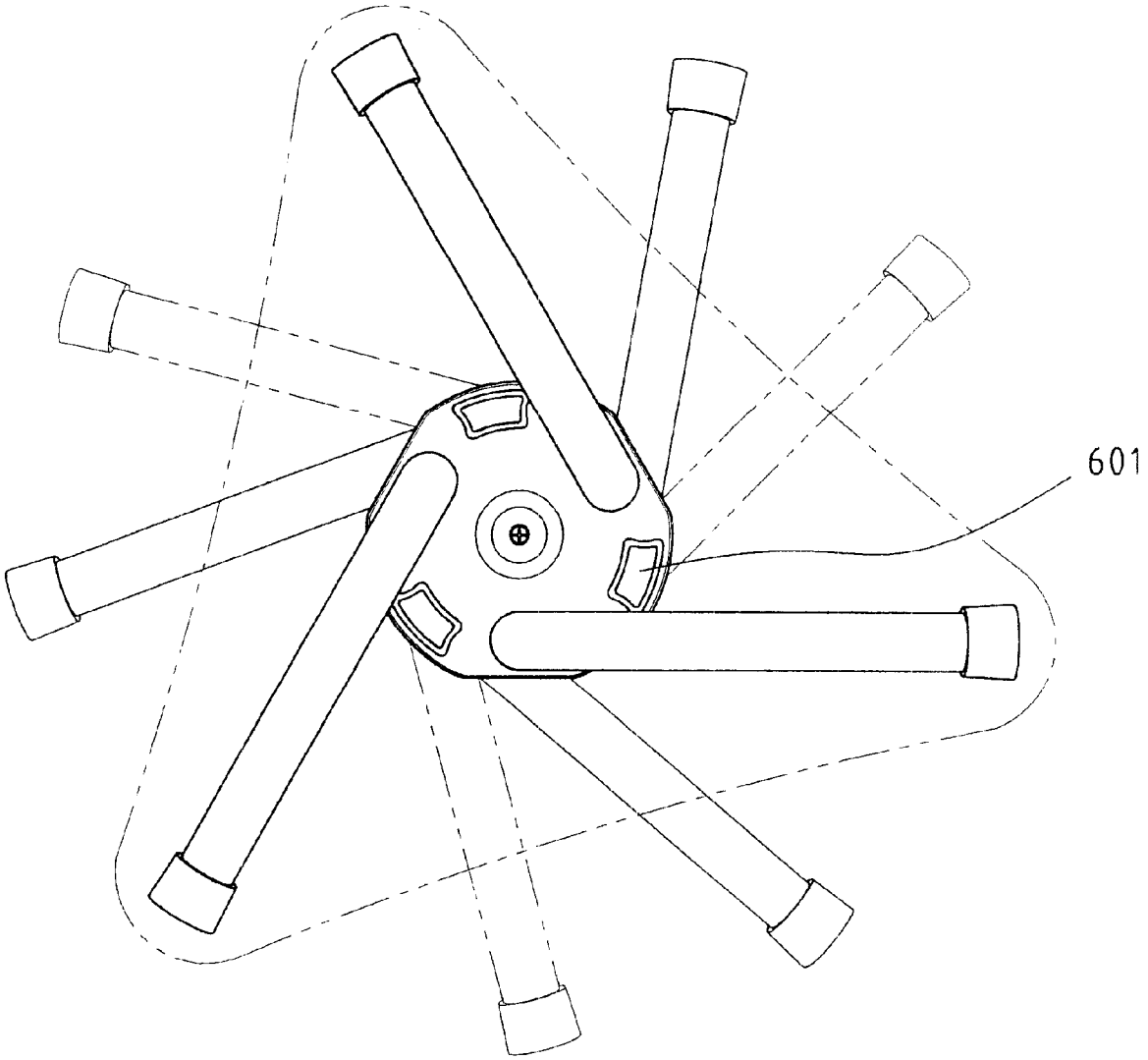
FIG. 6 shows a see-through top view of the foldable swivel stool according to the present invention.
Figure 7:
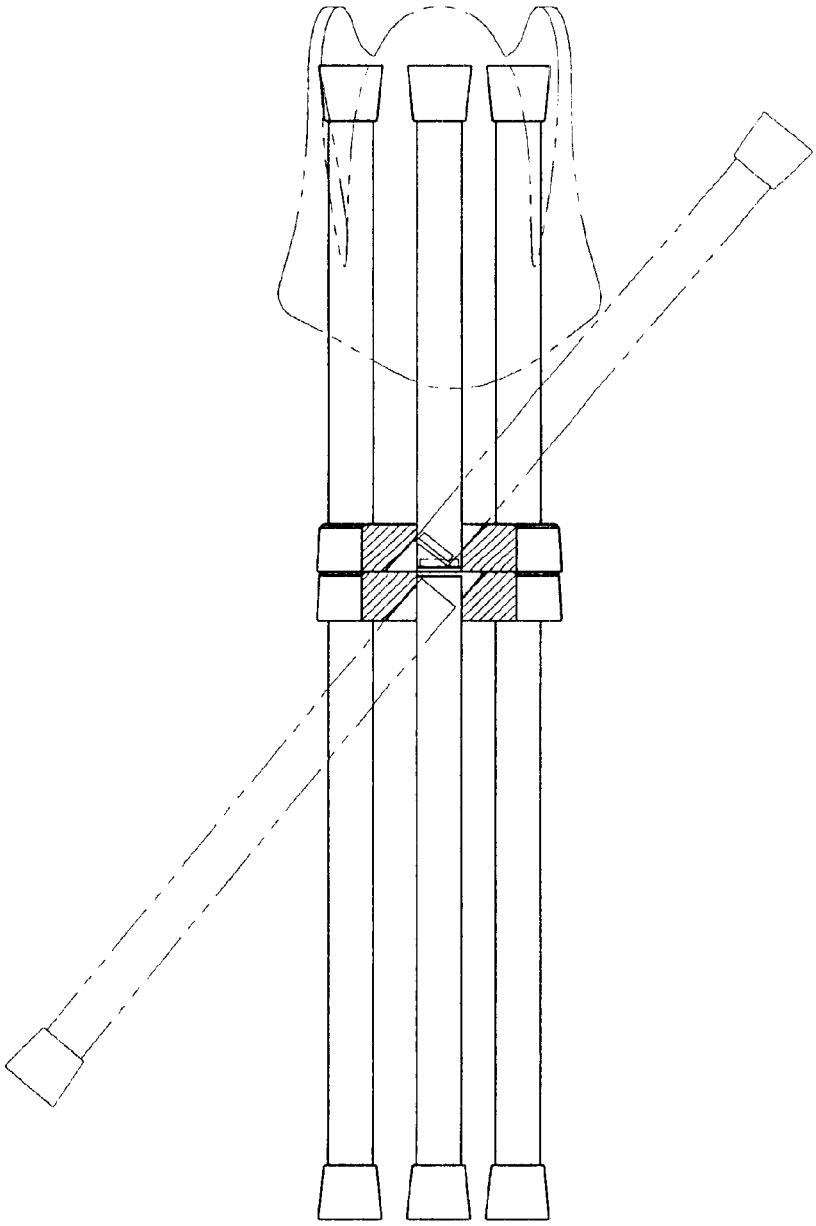
FIG. 7 shows the foldable swivel stool being folded and collapsed for easy carrying.

FIG. 6 shows a see-through top view of the foldable swivel stool in an opened position according to this invention. To reduce material cost, voids 601 may be formed on the disks. FIG. 7 shows a side view of the foldable swivel stool in a folded position.

Figure 8:
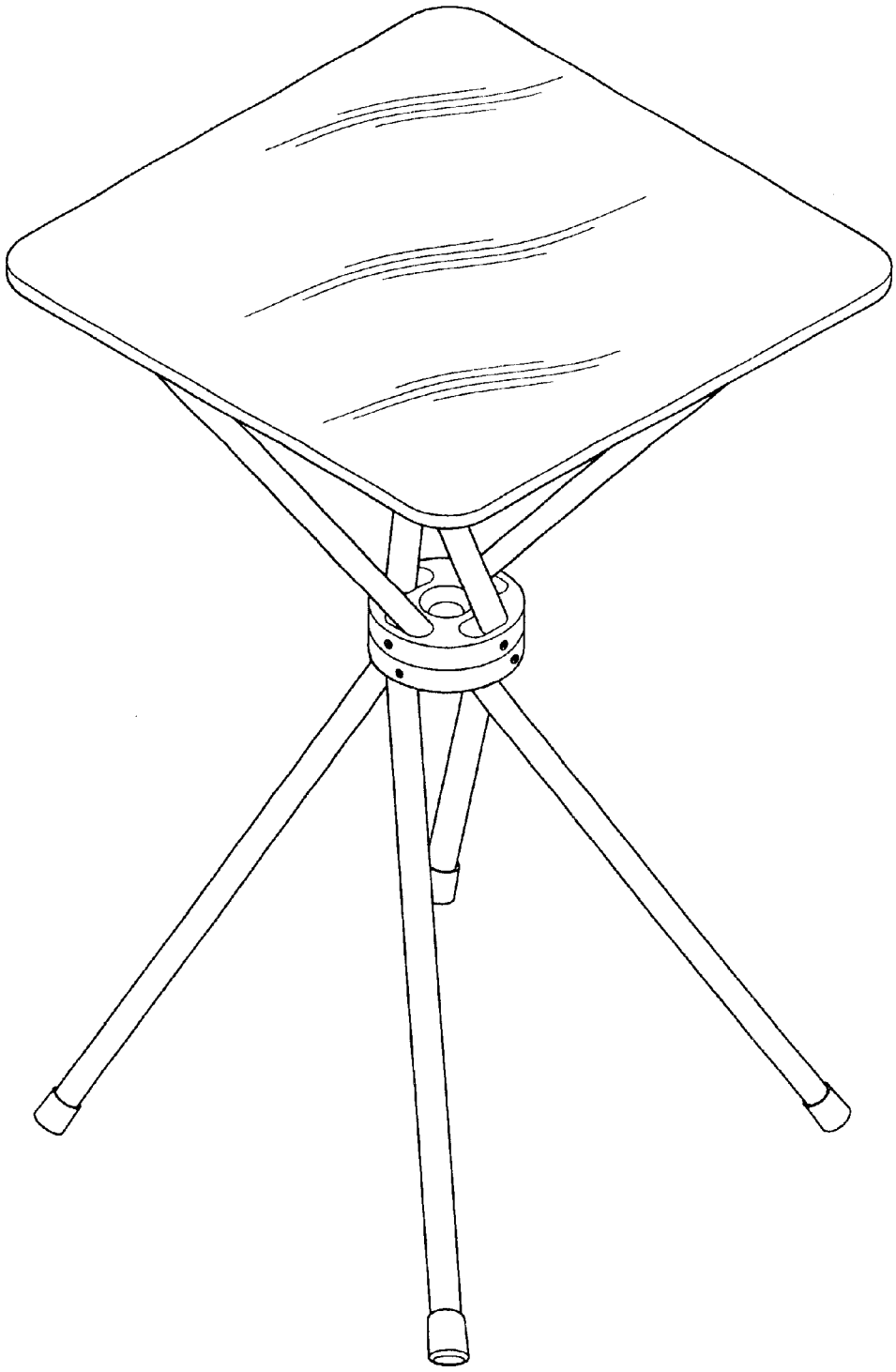
FIG. 8 shows a foldable swivel table according to the present invention.

The swivel mechanism of this invention can be used in different furniture. The above description shows a foldable stool having three leg members and three supporting members as an example. More holes can be formed in the upper and lower disks to accommodate more leg members and supporting members. FIG. 8 shows an example of a foldable swivel table with four legs according to this invention.

The rotatable assembly as shown in FIG. 5 comprises a rotatable device 3023 having a plurality of ball members housed in a groove formed on a ring-shaped body. The manufacture of the rotatable device requires high precision to ensure that the balls can be rolling smoothly within the device. Therefore, the cost associated with manufacturing the swivel mechanism is fairly expensive.

Figure 9:
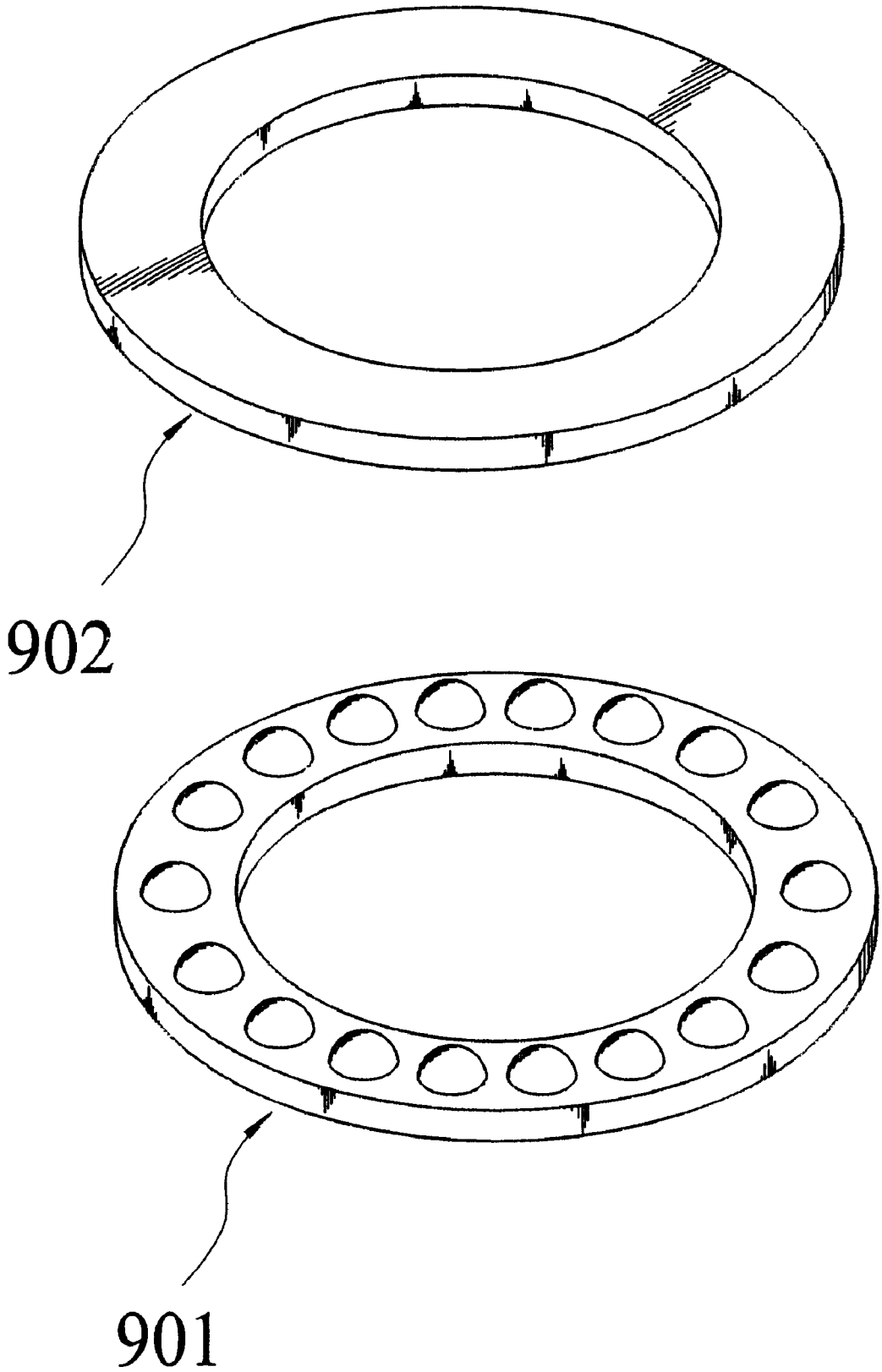
FIG. 9 shows another rotatable assembly in which one ring member having a plurality of convex bumps according to the present invention.

The invention further provides an improved structure for the rotatable assembly. As shown in FIG. 9, the improved roatable assembly comprises two ring members to be stacked together. The first ring member 902 has a flat surface. The second ring member 901 comprises a plurality of convex bumps on a surface as can be seen in FIG. 9. When the two ring members are stacked together, they only contact at the top area of each convex bump.

Because of the small contact area, the friction between the two ring members is very small. As a result, the two ring members can rotate with respect to each other without having to rely on the ball members rolling between them. The rotatable assembly is usually made of metal. The preferred material for the ring members is stainless steel. The rotatable assemly of FIG. 9 can be assembled with the two disks in the swivel mechanism as in assembling the rotatable assembly without the rotatable device shown in FIG. 3.

Figure 10:
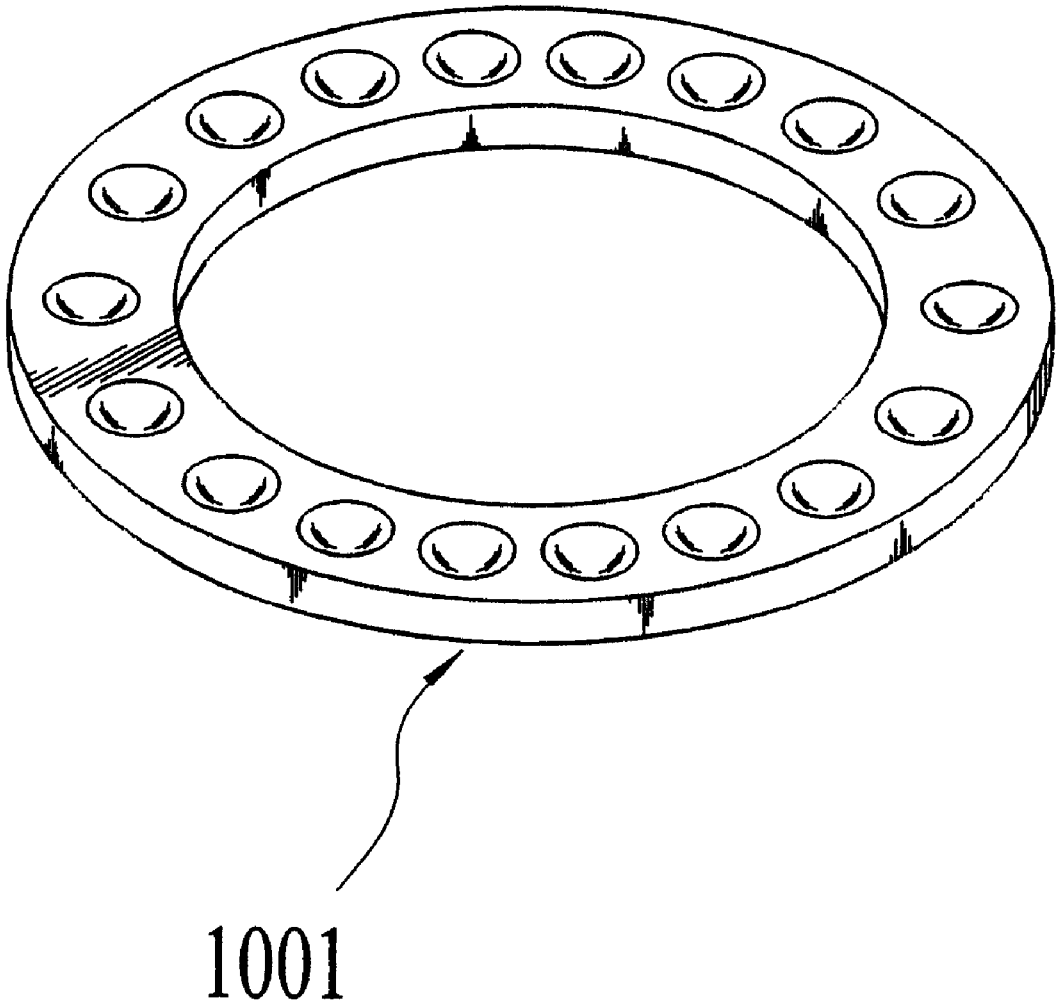
FIG. 10 shows a bottom view of the ring member having concave bumps.

A portion of each ring member 901 or 902 can also be embedded in one of the disks. In order that the swivel mechanism can be roatated smoothly, a small gap has to be maintained after the ring members and the disks are assembled. FIG. 10 shows a bottom view 1001 of the ring member 901 that has convex bumps. As can be seen, a plurality of concave structures may be formed because of the plurality of convex bumps on the other side. It should be noted that the concave structures are not necessary for the rotatable assembly to function properly. Dependent on the method and cost of manufacturing the ring member, the ring member may also have bump structures on one side and a flat surface on the other side without the concave structures.

As described above, the leg or supporting members are jointly connected to the lower or upper disks within through holes by means of pivot pins. When the furniture is swiveled around, significant twist and pressure are applied to the pivot pins and the ends of tubes that are jointly connected. Consequently, pivot pins and tubes are often dented and damaged. The present invention also provides an improved structure for the upper and lower disks to increase the durability of the furniture.

Figure 11:
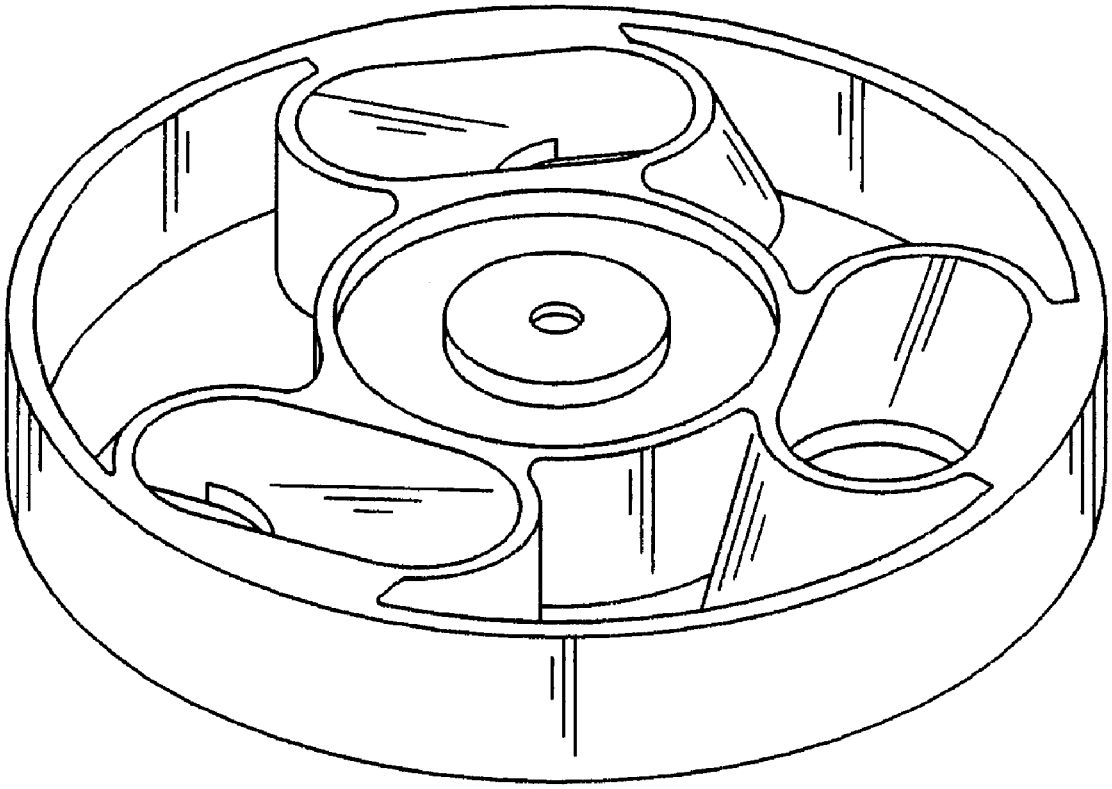
FIG. 11 shows the perspective top view of an example of the lower disk of the swivel mechanism according to the present invention.
Figure 12:
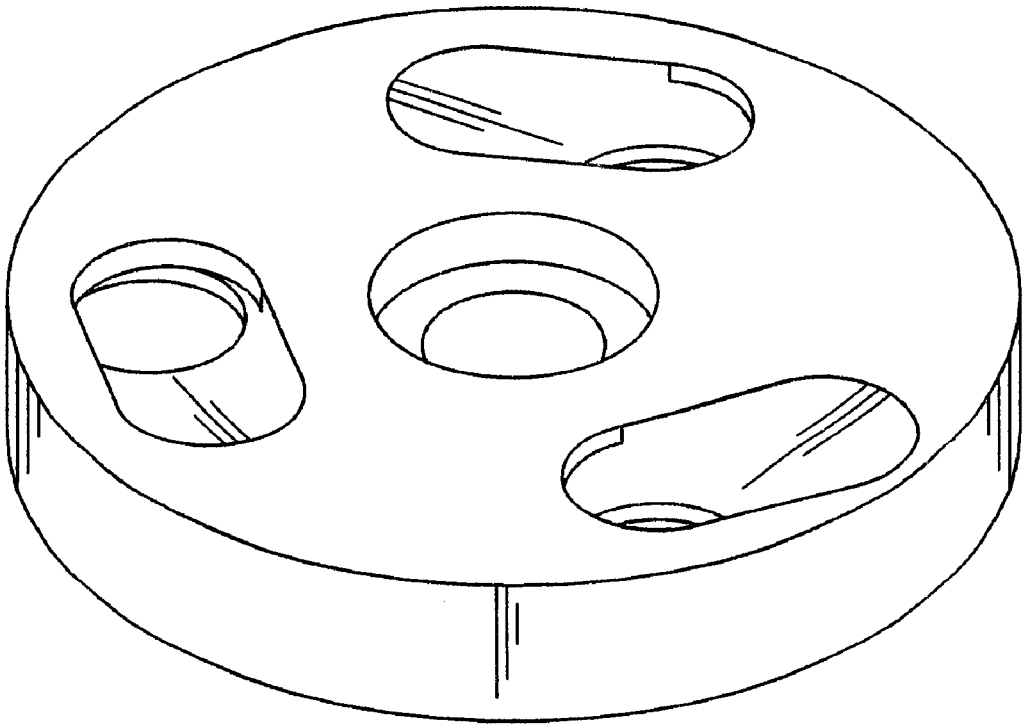
FIG. 12 shows the perspective bottom view of an example of the lower disk of the swivel mechanism according to the present invention.

FIGS. 11 and 12 show the perspective top and bottom views of an example of the lower disk 3025 of FIG. 3. As can be seen, each hole is designed to receive a leg member. The hole is slightly larger than the diameter of the tube of a leg member and shaped so that the leg member can be held vertical to the disk or slanted and restrained within an angle.

Although the upper disk 3021 of FIG. 3 may have similar structure as the lower disk 3025, this invention uses an improved structure as the upper disk to make the furniture more durable. Because the rotation of the furniture is accomplished by applying force on the supporting members to make the upper disk rotate against the lower disk, the joint ends of the supporting members and the upper disk are constantly twisted and pressured. The joint pin or the supporting member is easily dented or damaged due to insufficient support. Therefore, improved structure whose bottom and top views are shown in FIGS. 13 and 14 are used for the upper disk.

Figure 13:
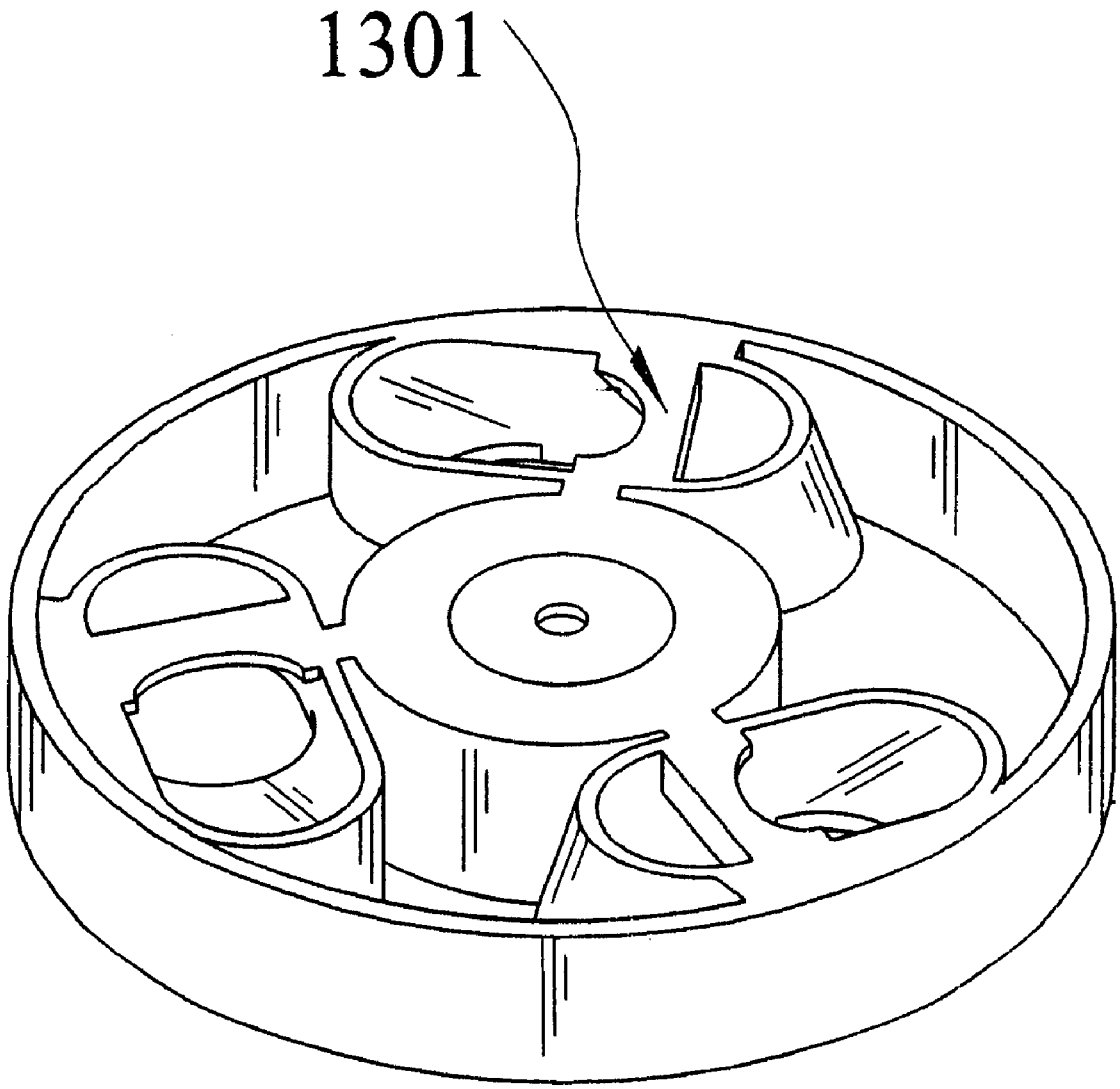
FIG. 13 shows the perspective bottom view of an example of the upper disk of the swivel mechanism according to the present invention.
Figure 14:
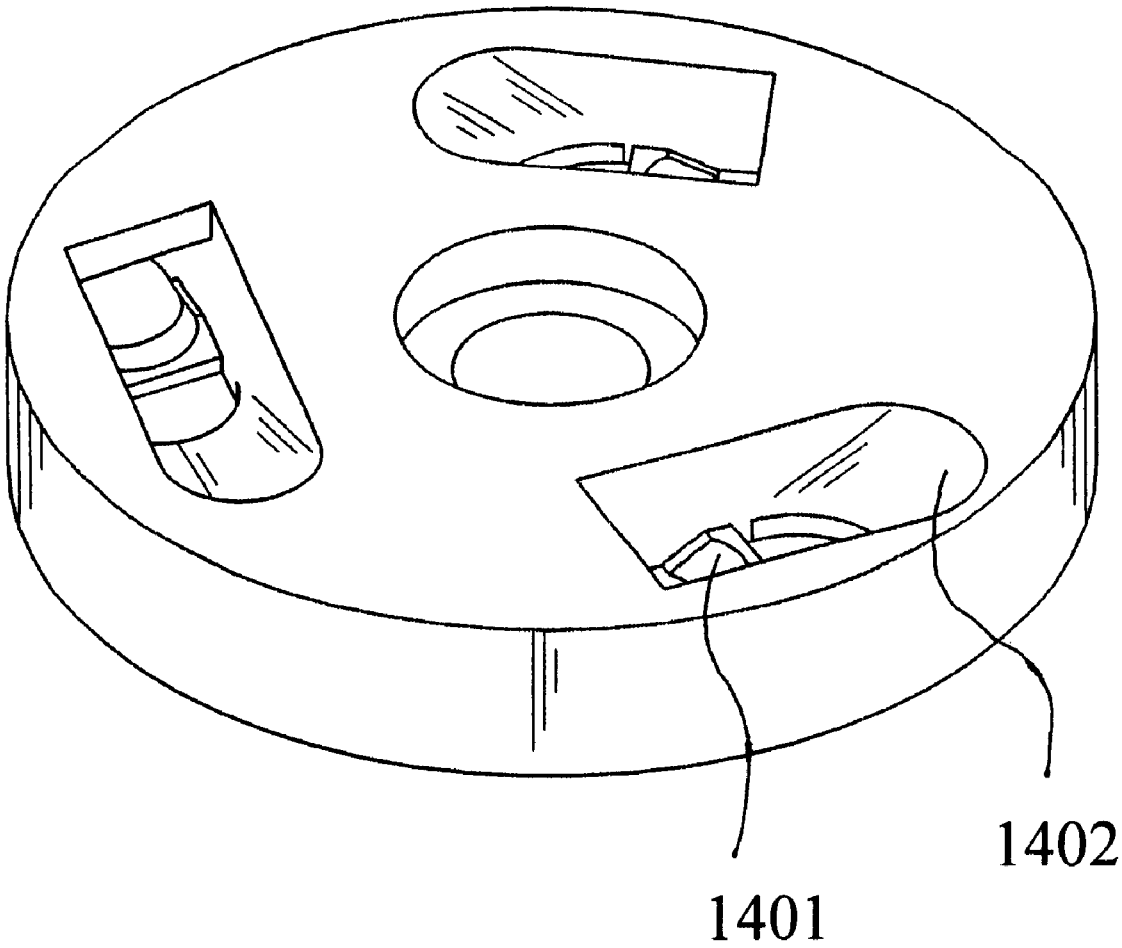
FIG. 14 shows the perspective top view of an example of the lower disk of the swivel mechanism according to the present invention.

With references to FIGS. 13 and 14, each hole for jointly connecting a supporting member has a bridge member 1301 formed across the hole. One side of the bridge member 1301 has a slanted concave surface 1401. FIG. 13 shows the upper disk's bottom view which faces the lower disk. The bridge member is formed near the bottom of the hole. As can be seen from FIG. 14, one side wall of each hole also has a slanted concave surface 1402.

Figure 15:
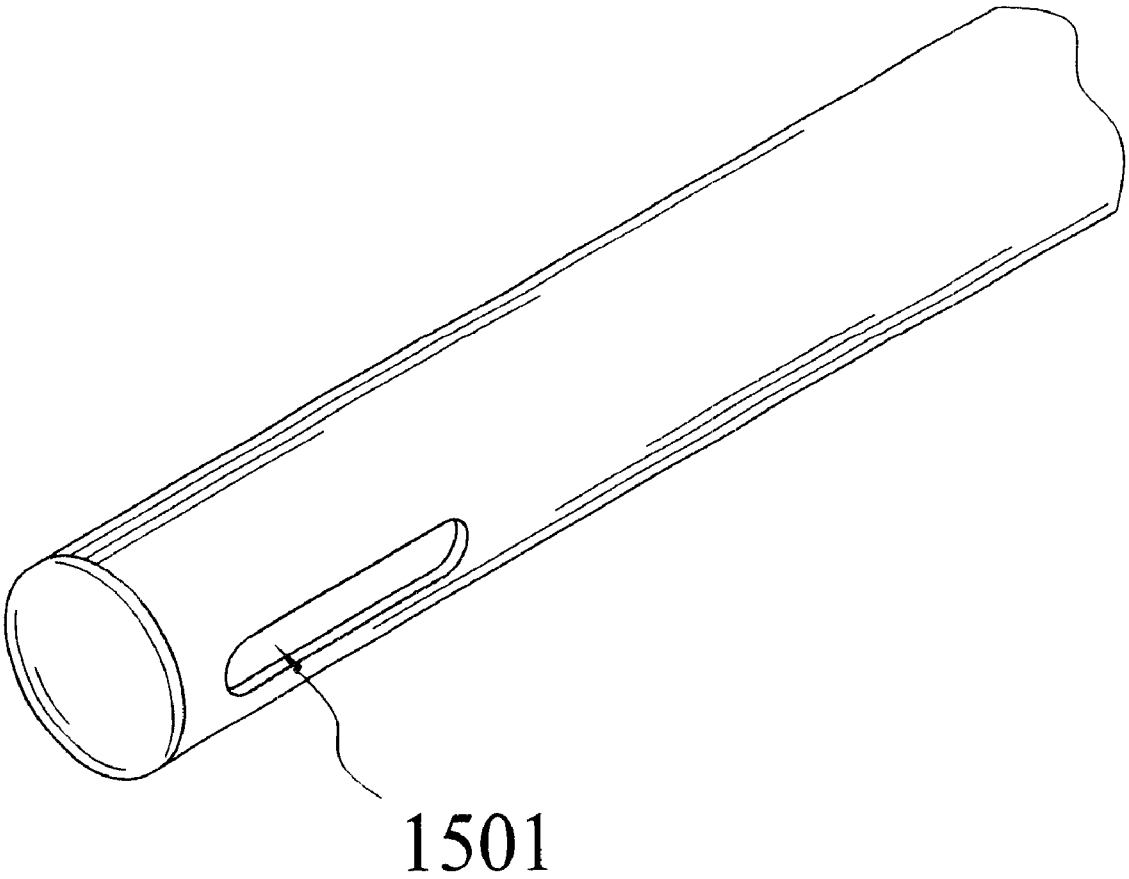
FIG. 15 shows the supporting member of the swivel furniture according to the present invention with a slit formed on the joint end.

The joint end of a supporting member has a slit 1501 formed thereon as shown in FIG. 15. A pivot pin passes through the slit for jointly connecting one end of the supporting member to the upper disk within the hole. Because of the slit, the supporting member can be moved higher to a position vertical to the upper disk for being folded together with other supporting members. When the supporting member is moved lower slantwise, the joint end is engaged deeper into the hole and supported by the slanted concave surfaces of the bridge member and the side wall of the hole. The slanted concave surfaces provide strong support to the supporting member and prevent it from being dented or damaged due to too much movement.

In general, only the supporting members and the upper disk require the stronger structure as described above because the supporting members have to withstand more twist as well as pressure. Nevertheless, similar structure can also be manufactured for the leg members and the lower disk to increase the durability of the furniture.

Figure 16:
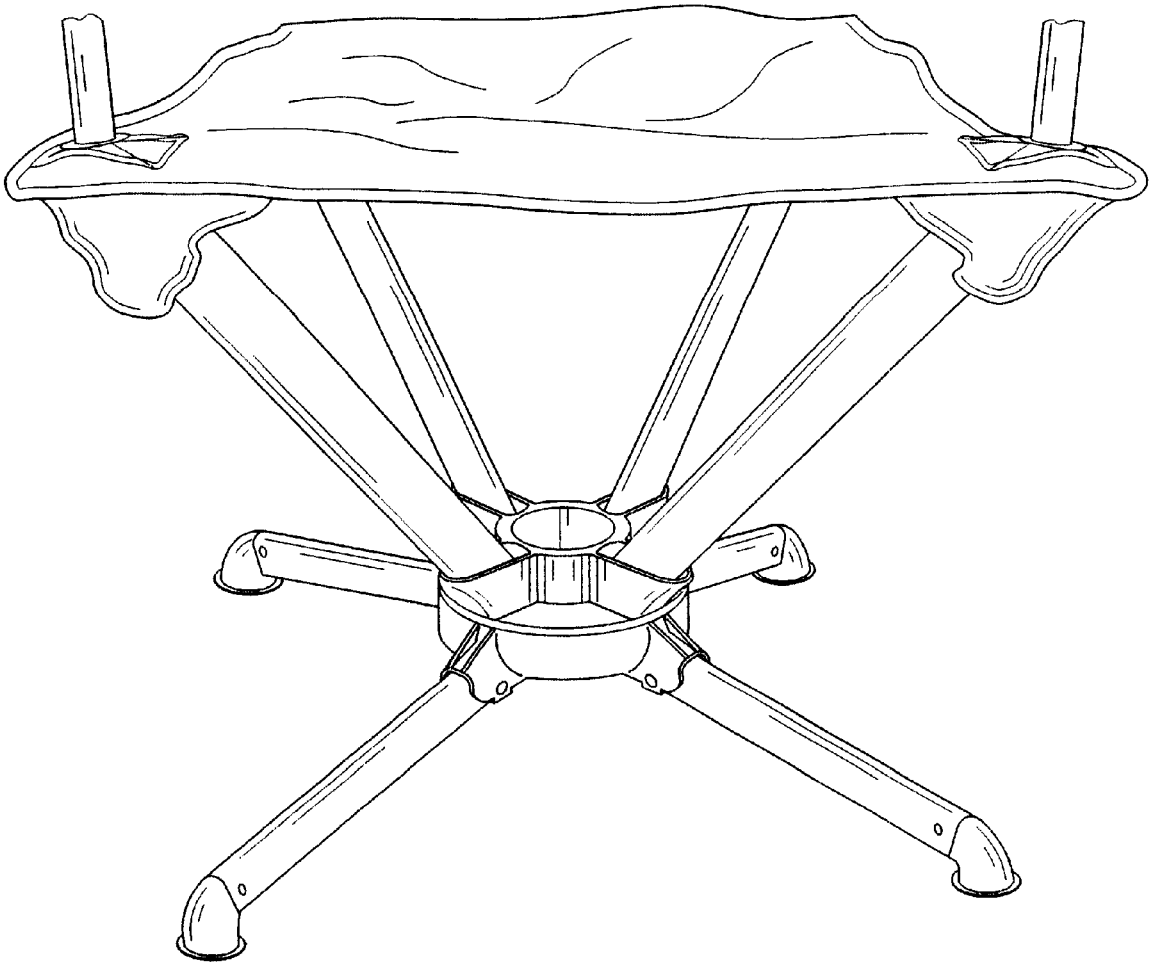
FIG. 16 shows a swivel chair according to the present invention.
Figure 17:
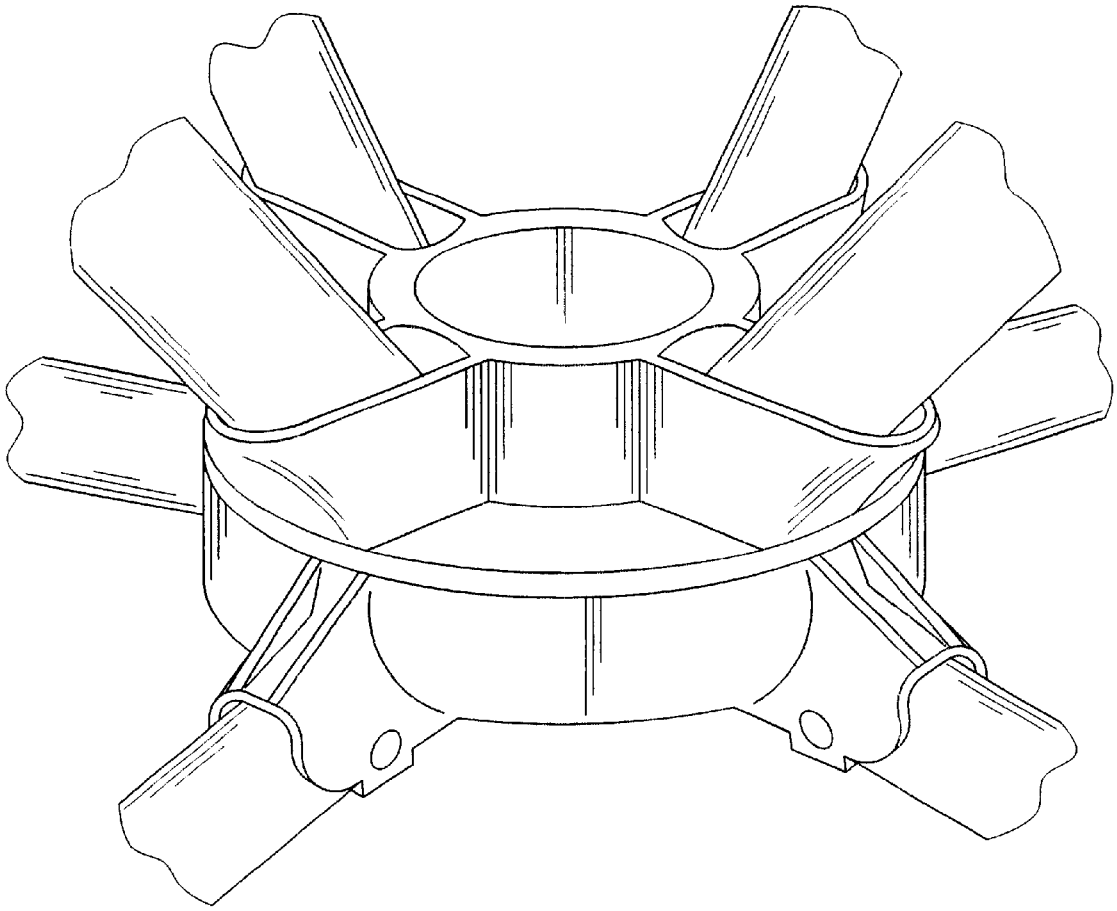
FIG. 17 shows a magnified view of the swivel mechanism of the swivel chair shown in FIG. 16.

In the present invention, the leg members, supporting members, upper and lower disks may also be shaped differently to accommodate different types of furniture. FIG. 16 shows the lower part of a swivel chair having four leg members and four supporting members according to the invention. As can be seen, the cross sections of the leg members and the supporting members are substantially rectangular. Portions of upper disks and lower disks are removed to save the cost and reduce weight. FIG. 17 shows a magnified view of the swivel mechanism of the swivel chair shown in FIG. 16.

Although only the preferred embodiments of this invention were shown and described in the above description, various modification or combination that comes within the spirit of this invention may also be made by a person skilled in the field according to the principle described. The invention is intended to be limited only by the appended claims.

What is claimed is:

1. An article of foldable swivel furniture, comprising:

a first disk having a plurality of through holes each receiving a leg member for jointly connecting said leg member to said first disk;

a second disk having a plurality of through holes each receiving a supporting member for jointly connecting said supporting member to said second disk, each through hole of said second disk further having a side wall and a bridge member formed therein, said side wall having a slanted concave surface and said bridge member having one side with a slanted concave surface for engaging with said supporting member when said supporting member is held in a slanted and open position with respect to said second disk; and a rotatable assembly being sandwiched between said first and second disks;

wherein a gap is maintained between said first and second disks, the two disks are rotatable with respect to each other by means of said rotatable assembly, and said supporting member is jointly connected to said second disk by means of a pivot pin passing through a slit formed near one end of said supporting member.

2. The article of foldable swivel furniture according to claim 1, wherein each through hole of said first disk further has a side wall with a slanted concave surface, and a bridge member having one side with a slanted concave surface for engaging with said leg member when said leg member is held in a slanted and open position with respect to said first disk.

3. The article of foldable swivel furniture according to claim 1, said foldable swivel furniture being a foldable chair having four supporting members and four leg members each having a substantially rectangular cross section.

4. The article of foldable swivel furniture according to claim 1, wherein a portion of said rotatable assembly is embedded in one of said first and second disks.

5. The article of foldable swivel furniture according to claim 1, wherein said first disk further has a plurality of portions removed for saving cost and reducing weight.

6. The article of foldable swivel furniture according to claim 1, wherein said second disk further has a plurality of portions removed for saving cost and reducing weight.

* * * * *